US012173728B1

(12) United States Patent
Keener

(10) Patent No.: US 12,173,728 B1
(45) Date of Patent: Dec. 24, 2024

(54) SUBMERSIBLE PUMP WITH EXTERNAL SLICER

(71) Applicant: Gregg Keener, Ashland, OH (US)

(72) Inventor: Robert Keener, Ashland, OH (US)

(73) Assignee: Gregg Keener, Ashland, OH (US)

( * ) Notice: Subject to any disclaimer, the term of this patent is extended or adjusted under 35 U.S.C. 154(b) by 0 days.

(21) Appl. No.: 18/121,282

(22) Filed: Mar. 14, 2023

Related U.S. Application Data

(60) Provisional application No. 63/323,239, filed on Mar. 24, 2022.

(51) Int. Cl.
*F04D 29/22* (2006.01)
*F04D 7/04* (2006.01)
*F04D 13/08* (2006.01)

(52) U.S. Cl.
CPC ..... *F04D 7/045* (2013.01); *F04D 13/086* (2013.01); *F04D 29/2288* (2013.01)

(58) Field of Classification Search
CPC .... F04D 7/045; F04D 13/086; F04D 29/2288; F04D 29/70; F04D 29/708
See application file for complete search history.

(56) References Cited

U.S. PATENT DOCUMENTS

| | | | | |
|---|---|---|---|---|
| 7,159,806 | B1 * | 1/2007 | Ritsema | F04D 3/02 241/89.4 |
| 8,784,038 | B2 * | 7/2014 | Ciotola | B02C 18/0092 415/121.1 |
| 10,364,821 | B2 * | 7/2019 | Pohler | F04D 29/2288 |
| 11,161,121 | B2 * | 11/2021 | Brinkmann | F04D 7/045 |
| 2019/0321827 | A1 * | 10/2019 | Bäcke | E03C 1/2665 |

* cited by examiner

*Primary Examiner* — David E Sosnowski
*Assistant Examiner* — Jason G Davis
(74) *Attorney, Agent, or Firm* — Ralph E. Jocke; WALKER & JOCKE

(57) ABSTRACT

An exemplary pump (10) is operative to reduce the size of solids suspended in liquid that enters the interior area of the pump. The pump includes a motor (28) that is operative to drive an impeller (56) that is located in a pump chamber (42). The motor is also operative to drive a slicer (80) that includes at least one slicer blade edge (96). The slicer blade edges move in immediately adjacent outwardly overlying relation of a slicer plate (66) which includes a plurality of slicer plate fluid openings (78). Solids suspended in liquid that extend in the slicer plate fluid openings are sliced between the slicer blade edges and the facing peripheral shearing edges of the slicer plate fluid openings so that the solids are reduced to a size that can pass through the pump.

22 Claims, 15 Drawing Sheets

SUBMERSIBLE PUMP WITH EXTERNAL SLICER

TECHNICAL FIELD

Exemplary arrangements relate to pumps suitable for pumping liquid material. Exemplary arrangements specifically relate to submersible pumps that are usable for pumping sewage or other material including solids therein. Exemplary arrangements include an external slicing mechanism for reducing the size of solids before they enter the interior of the pump.

BACKGROUND

The movement of liquid material is important in many different types of processes. The movement of liquid usually requires one or more pumps that cause the liquid to move between locations. The reliability of pumps to move liquids is critical to assuring that problems and damage to systems is avoided.

The pumping of a liquid becomes more challenging when the liquid includes suspended solids therein. Suspended solids that are of a large size, hard and/or comprised of resilient material may cause clogging, binding or damage to a pump resulting in pump failure. The pumping of sewage is often particularly challenging due to the various types of solid materials that may be suspended in the liquid waste flow.

Liquid pumps may benefit from improvements.

SUMMARY

Exemplary arrangements relate to a submersible pump that may be utilized for pumping liquid materials that include various types of suspended solids. Some exemplary arrangements are submersible pumps that are particularly useful in pumping sewage.

An exemplary arrangement includes a pump having the housing that includes a motor. The motor is operative to selectively rotate a drive shaft. The housing includes a pump chamber including an inlet opening that enables liquid to enter the pump chamber, and an outlet opening that enables the liquid to leave the pump chamber. An impeller is rotatably movably mounted in the pump chamber and is in operative connection with the drive shaft.

In an exemplary arrangement a housing inlet is configured to be in fluid communication with the inlet opening of the pump chamber. A slicer plate is positioned in outwardly overlying relation of the housing inlet and the inlet opening. The exemplary slicer plate includes at least one slicer plate fluid opening therethrough. The slicer plate further includes an axially aligned slicer plate drive opening through which a shaft in operative connection with the drive shaft rotatably extends.

A slicer is positioned in outwardly overlying relation of the slicer plate. The slicer includes at least one slicer blade edge that is positioned immediately adjacent to an outward facing slicer face of the slicer plate. The slicer is in operative connection with the drive shaft. Rotation of the slicer is operative to cause the at least one slicer blade edge to move in immediately adjacent relation across each of the slicer plate fluid openings.

The motor is operative to cause rotation of the impeller and the slicer. Rotation of the impeller is operative to draw liquid into the pump chamber through the housing inlet and the at least one slicer plate fluid opening in the slicer plate.

The impeller is operative to cause the liquid to move through the pump chamber and be discharged from the pump chamber through the outlet opening. Movement of the at least one slicer blade edge across the slicer plate fluid openings is operative to cut (alternatively referred to herein as slice) solid material that extends into each of the fluid openings and reduce the size of the solid materials before they can enter the interior of the pump housing. The slicer is operative to slice and chop the solids into smaller pieces that can pass through the pump.

Numerous additional features and benefits are provided in the exemplary arrangements described in the Detailed Description herein.

DETAILED DESCRIPTION

Figure 1:
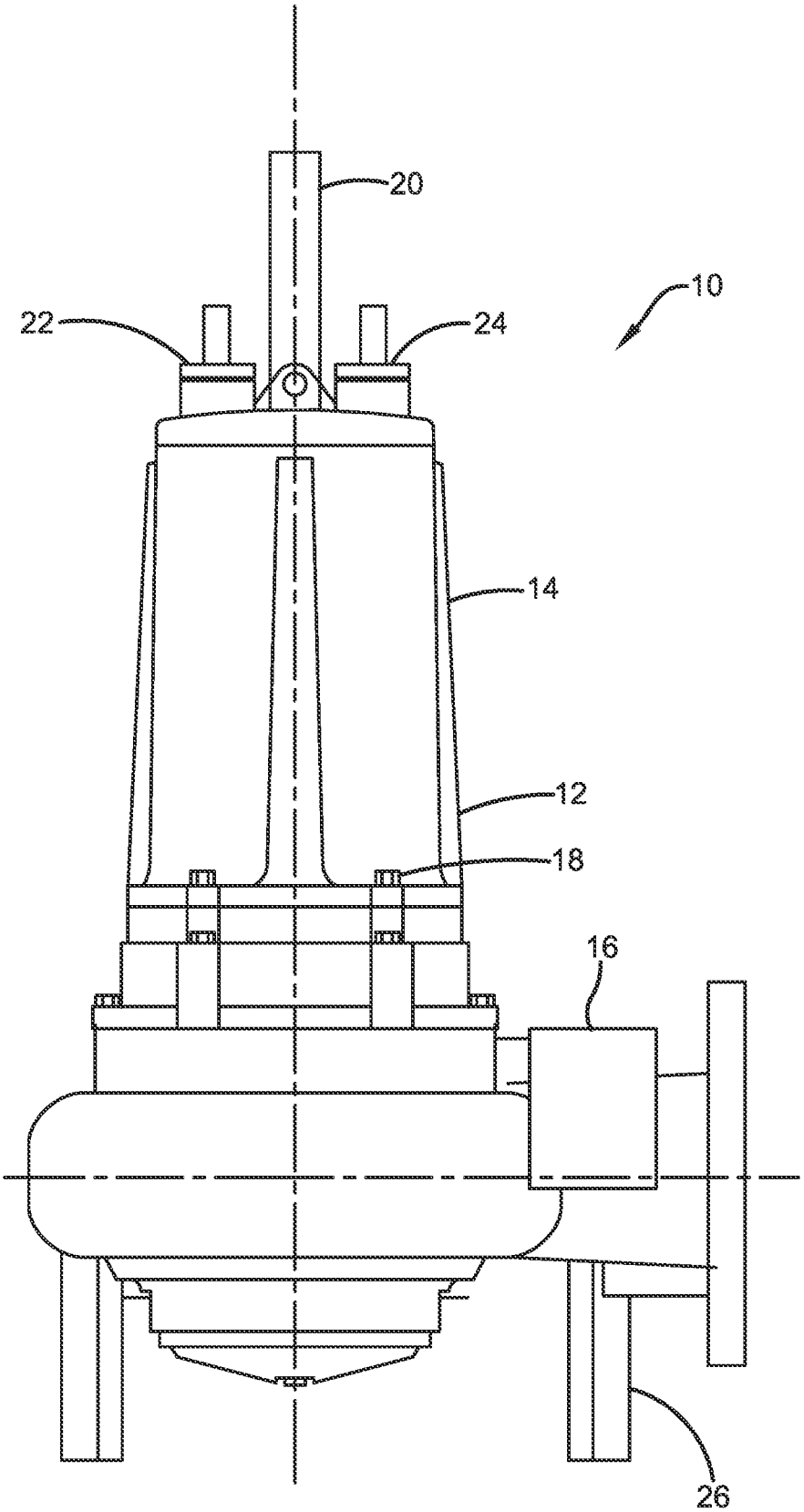
FIG. 1 is a side view of an exemplary submersible pump including features of an exemplary arrangement.
Figure 2:
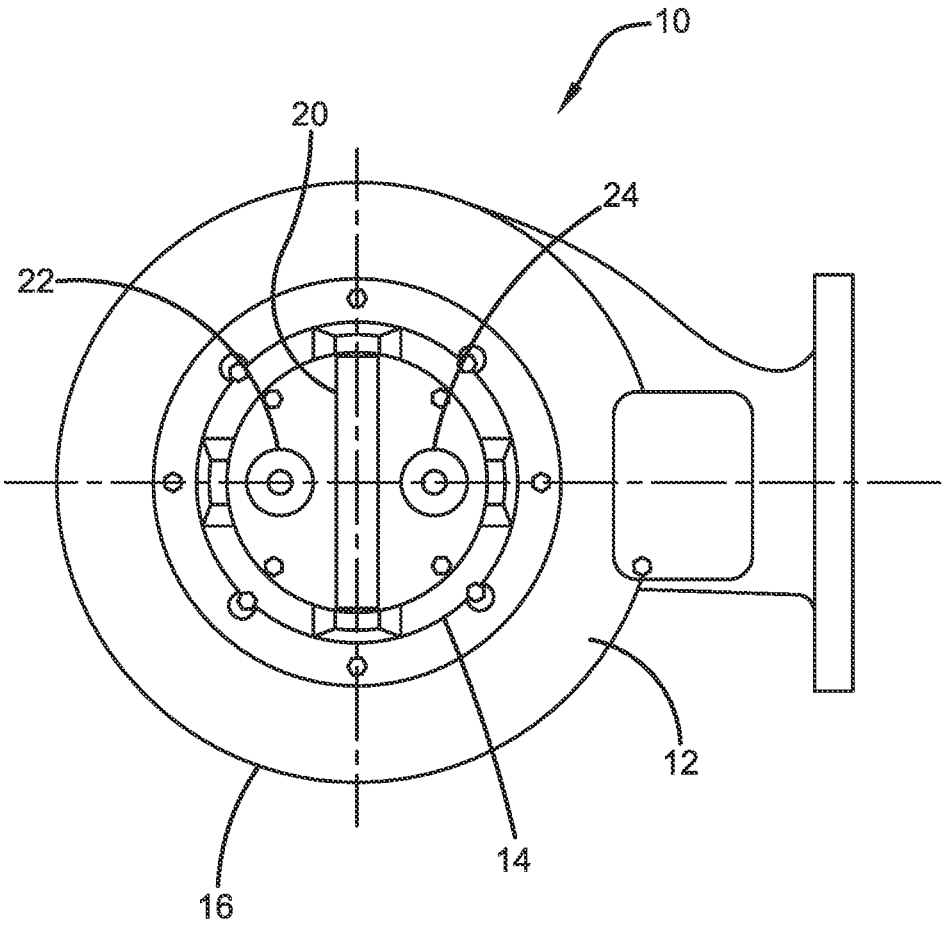
FIG. 2 is a top view of the exemplary submersible pump.

Referring now to the drawings and particularly to FIG. 1 there is shown therein an exemplary submersible pump generally indicated 10. The pump includes a housing 12. The exemplary housing in an operative position as shown includes an upper portion 14 which houses at least a portion of a motor as later described herein. The exemplary housing further includes a lower portion 16 which houses a pump chamber and an impeller. The exemplary upper portion 14 and lower portion 16 are held in engaged relation through releasable fasteners 18. The top of the exemplary upper portion 14 includes a manually engageable handle 20. Also in the exemplary arrangement, the top of the upper portion includes an electrical connector 22 which is connected to a power supply cord 22. A further electrical connector 24 is in operative connection with a cord that is connected to an electrical switch such as a level switch that is operative to cause the motor of the pump to selectively turn on and off. Of course this arrangement is exemplary and in other arrangements other approaches may be used.

In the exemplary arrangement the lower housing portion 16 includes a plurality of vertically extending legs 26. The exemplary legs 26 may be engaged with a horizontal support surface on which the submersible pump is supported. The horizontal support surface may be the bottom of a sump, tank or holding basin in some arrangements.

Figure 3:
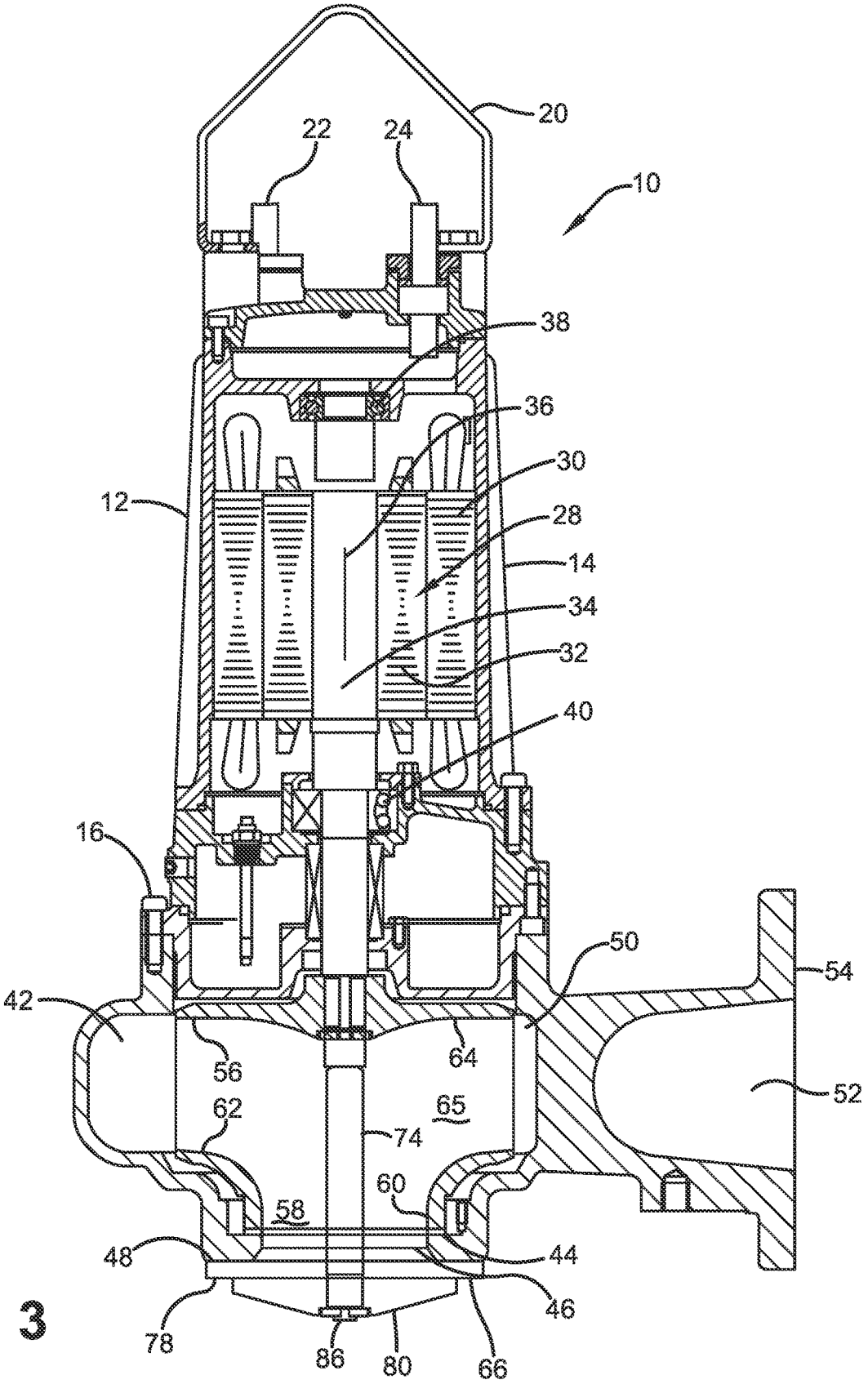
FIG. 3 is a cross sectional view of the exemplary submersible pump.
Figure 4:
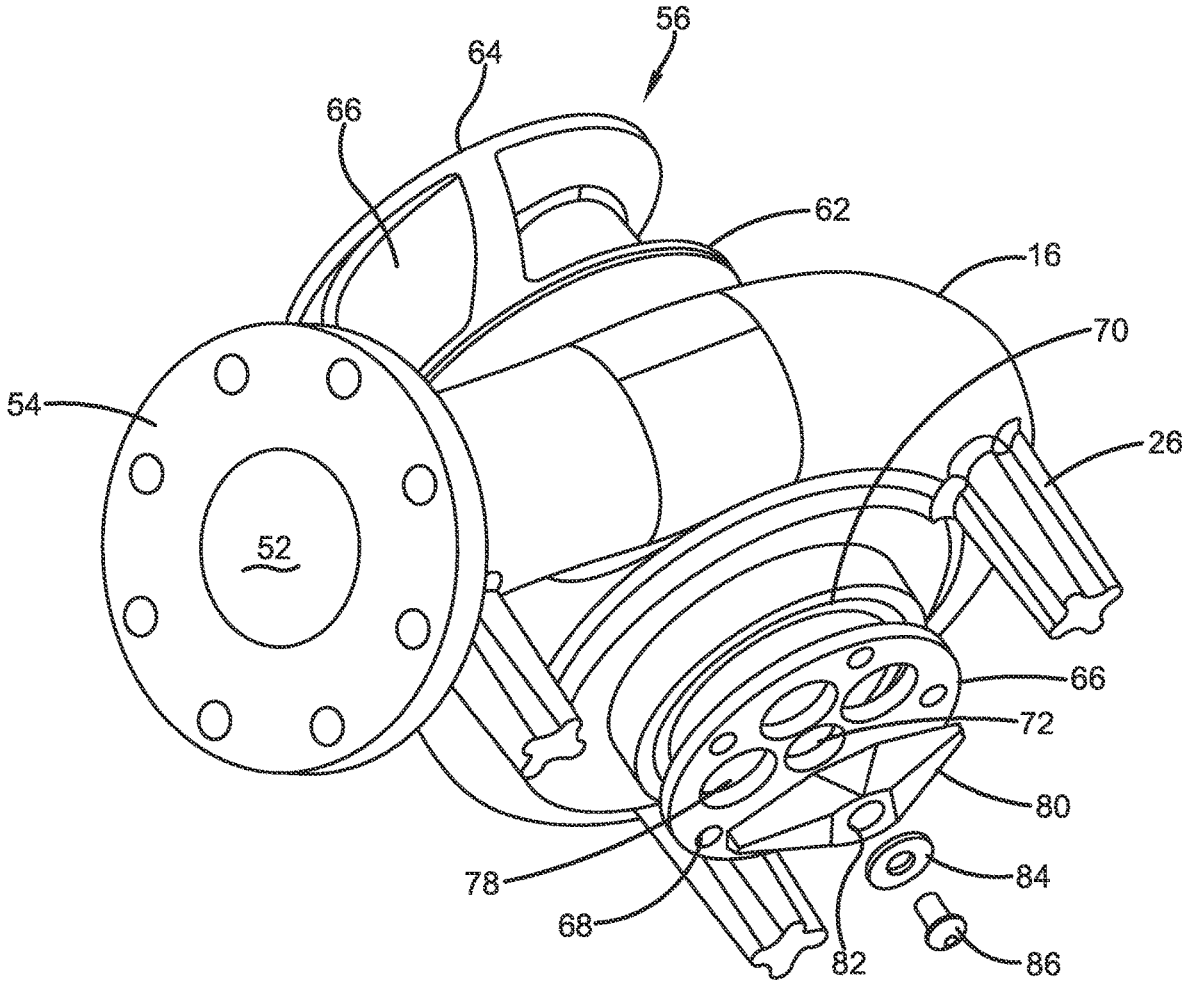
FIG. 4 is a bottom perspective exploded view of a lower portion of the exemplary submersible pump.
Figure 5:
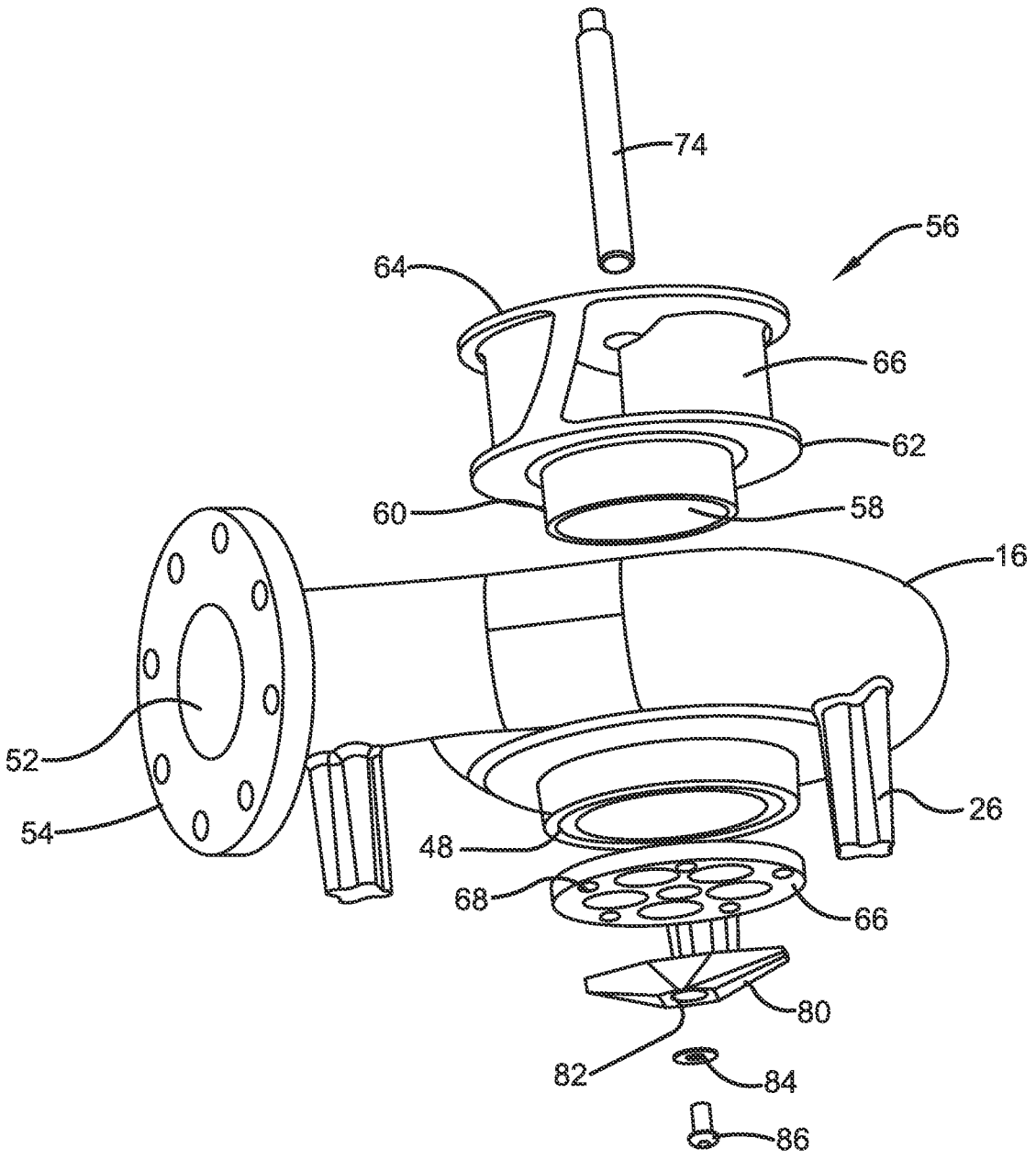
FIG. 5 is a side perspective exploded view of the lower portion of the exemplary submersible pump.
Figure 6:
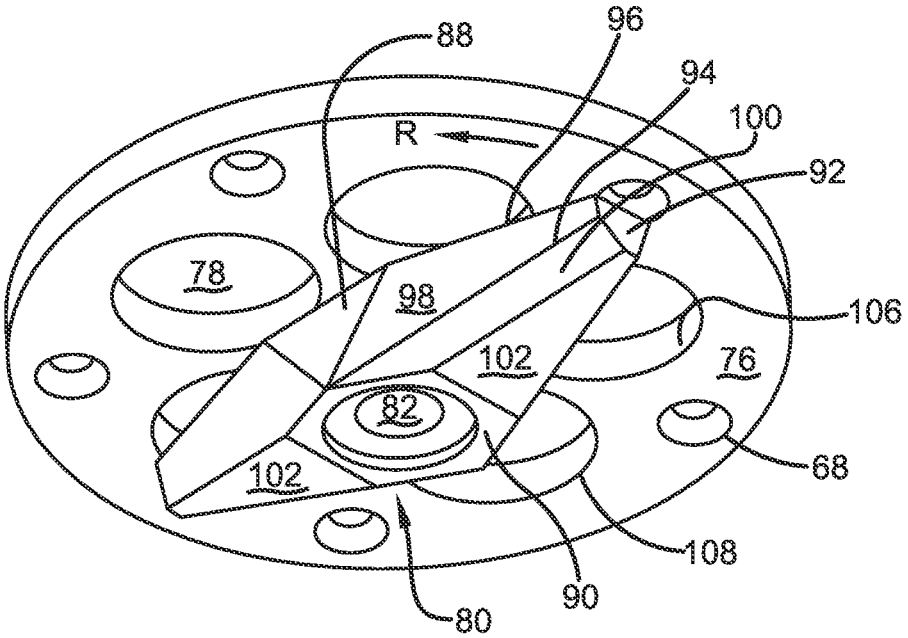
FIG. 6 is a bottom perspective view of an exemplary slicer plate and slicer of the exemplary submersible pump.
Figure 7:
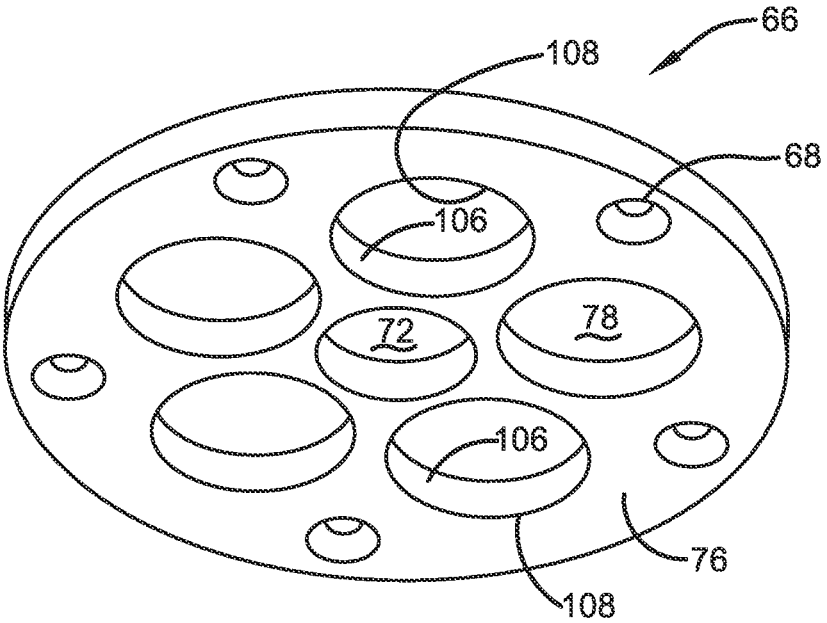
FIG. 7 is a bottom perspective view of the exemplary slicer plate.
Figure 8:
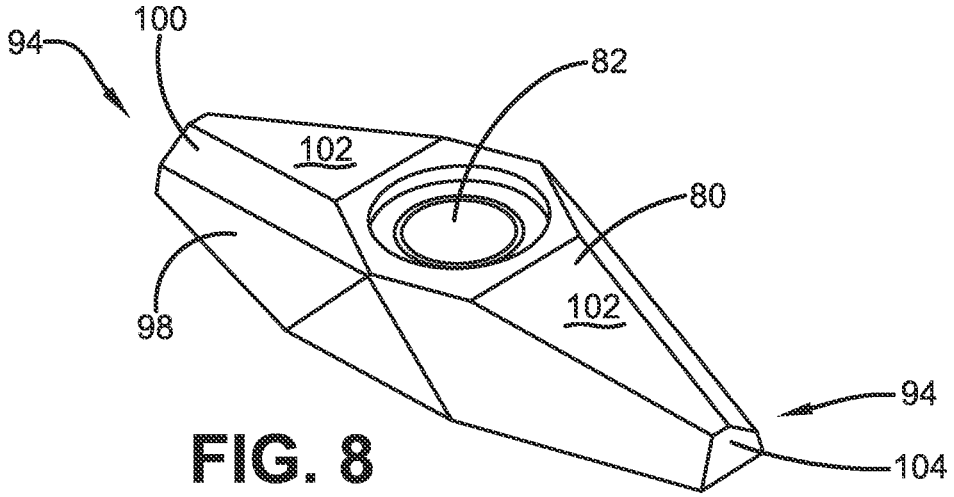
FIG. 8 is a top front right perspective view of the exemplary slicer.
Figure 9:
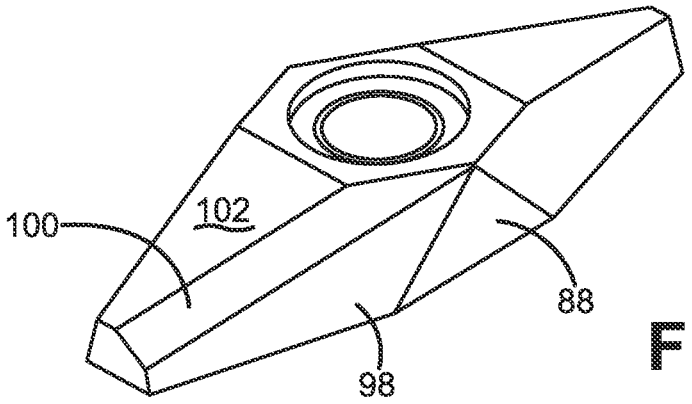
FIG. 9 is a top front left perspective view of the exemplary slicer.
Figure 10:
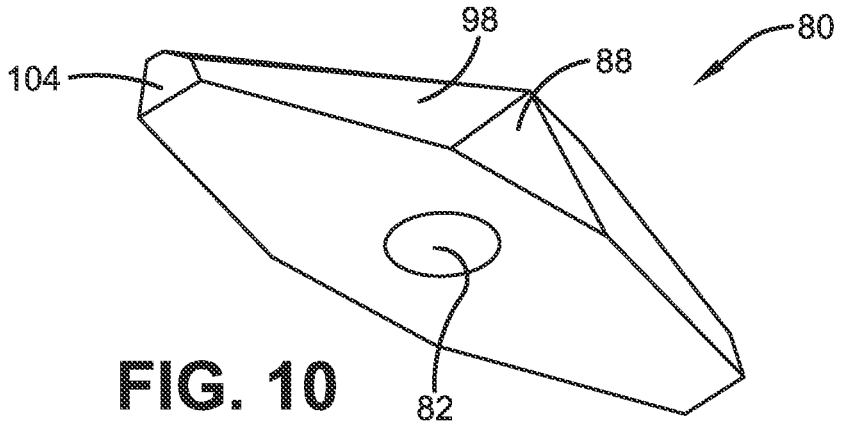
FIG. 10 is a bottom front left perspective view of the exemplary slicer.
Figure 12:
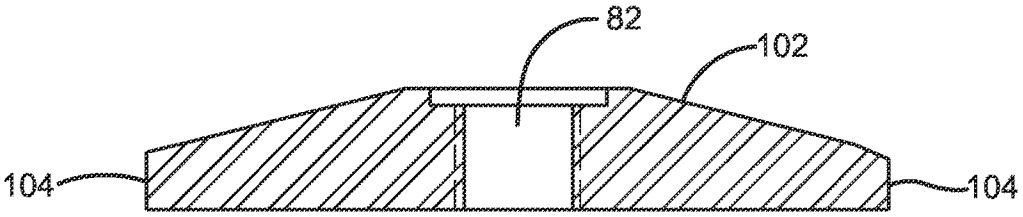
FIG. 12 is a sectional view of the exemplary slicer along line 12-12 in FIG. 11.
Figure 11:
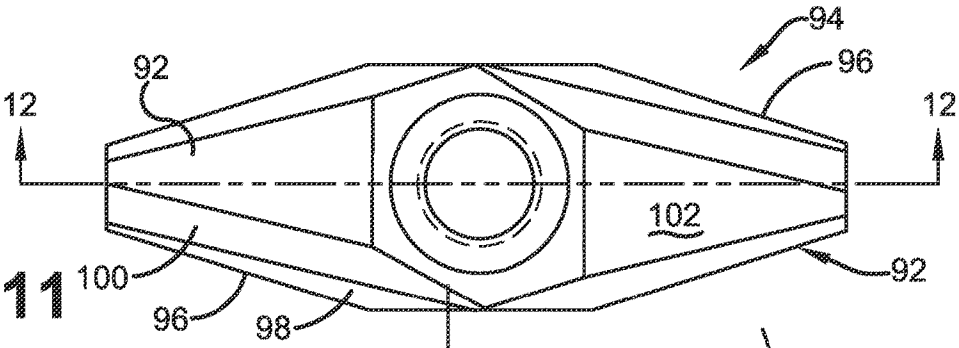
FIG. 11 is a top view of the exemplary slicer.

As shown in FIG. 3 the upper housing portion 14 houses a motor 28. The exemplary motor includes outer windings 30 that extend in surrounding relation of a rotatable armature 32. The armature is in fixed connection with a drive shaft 34. The drive shaft extends along an axis 36. In the exemplary arrangement when submersible pump 10 is in the operative position the axis 36 extends vertically. Of course it should be understood that this pump configuration is exemplary and in other arrangements other configurations may be used.

The exemplary drive shaft 34 is rotationally journaled in an upper bearing 38 and a lower bearing 40. The exemplary drive shaft 34 extends along the axial direction into the lower housing portion 16. The lower housing portion 16 bounds a pump chamber 42 within the housing. The exemplary pump chamber 42 includes an inlet opening 44 that in the exemplary arrangement is axially centered at the bottom of the pump chamber. The pump chamber further includes a housing inlet 46. The housing inlet in the exemplary arrangement comprises an axially centered circular inlet that is in fluid communication with the inlet opening 44 of the pump chamber 42. The exemplary housing inlet 46 is bounded externally by a circular substantially planar land surface 48 that extends perpendicular to the axis 36.

The pump chamber 42 of the exemplary arrangement further includes an outlet opening 50. The outlet opening is in fluid communication with a pump outlet 52. The exemplary pump outlet 52 is surrounded by a flange 54. The exemplary flange is configured for engaging a similar flange that is connected to an outlet pipe or similar fluid conduit.

An impeller 56 is positioned in the pump chamber 42. The exemplary impeller 56 is in operative connection with the drive shaft 34 and is rotatably movable within the pump chamber. The exemplary impeller 56 includes an axially centered bottom fluid receiving opening 58 that is surrounded by a cylindrical projection 60. The exemplary impeller 56 includes a lower circular plate 62 from which the cylindrical projection extends. The impeller also includes an upper circular plate 64. The exemplary upper plate 64 is in operative connection with the drive shaft 34. A plurality of radially outward extending curved vanes 65 extend between the upper plate 62 and the lower plate 64. The vanes are operative with rotation of the impeller to propel the liquid that is received upwardly through the pump inlet opening 44 and the bottom opening 58, radially outwardly within the pump chamber and outward through the outlet opening 50 and the pump outlet 52.

In the exemplary arrangement a slicer plate 66 is positioned in overlying relation of the housing inlet 46. In the exemplary arrangement the slicer plate 66 is positioned below the housing inlet in abutting relation with the land surface 48. The exemplary slicer plate includes a plurality of angularly spaced mounting holes 68 that extend therethrough. The mounting holes 68 are aligned with threaded fastener receiving openings 70 in the land surface. This arrangement enables the slicer plate 66 to be releasably engaged with the lower housing 16 of the pump.

The exemplary slicer plate 66 includes a central axially aligned slicer plate drive opening 72. A drive shaft extension 74 is in operative connection with the drive shaft 34 and extends through the axially centered slicer plate drive opening 72. The exemplary slicer plate includes a planar slicer face 76. Slicer face 76 in the operative position is directed downward away from the inlet opening 44 of the pump chamber and the housing inlet 46. The exemplary slicer plate includes at least one slicer plate fluid opening 78. The exemplary slicer plate fluid openings 78 are radially disposed from the axis and the slicer plate drive opening 72 at a common radial distance. In the exemplary arrangement the slicer plate includes an odd number of slicer plate fluid openings. This configuration is useful in the exemplary arrangement to assure that suitable slicing force to slice solids is available from the motor as later discussed.

In the exemplary arrangement the slicer plate fluid openings 78 extend through the slicer plate 66 and are each bounded by annular walls that extend parallel to the axis 36 at the slicer face 76. Further in the exemplary arrangement all of the slicer plate fluid openings 78 have a common diameter. However it should be understood that this arrangement is exemplary and in other arrangements other approaches and configurations for the plate fluid openings may be used.

A slicer 80 is positioned in operative connection with the drive shaft extension 74 in outwardly overlying relation underneath the slicer plate 66. The exemplary slicer 80 includes a central mounting opening 82. In the exemplary arrangement the slicer 80 is operatively connected to the drive shaft extension 74 by a locking washer 84 and a fastener 86. Of course it should be understood that this attachment arrangement is exemplary and in other arrangements other approaches may be used.

The exemplary slicer 80 includes a body 88 that includes a central portion 90 through which the mounting opening 82 extends. A pair of opposed radially outward extending arms 92 extend radially outward from the axis and in generally opposed relation from the central portion 90. In the exemplary arrangement each of the arms 92 extend radially outward a sufficient distance such that when the slicer rotates each of the arms passes over the entirety of each of the slicer plate fluid openings 78. Of course it should be understood that this configuration is exemplary.

In the exemplary arrangement shown the motor is operative to cause the slicer 80 to rotate in a rotational direction represented by Arrow R. Each respective slicer arm 92 includes a leading surface 94 that faces in the direction of movement of the slicer as the slicer moves in the rotational direction. Each leading surface terminates in immediately adjacent relation to the slicer face 76 at a slicer blade edge 96. In exemplary arrangements the slicer blade edge is disposed a relatively short distance outwardly away from the slicer face. In some exemplary arrangements the distance outwardly parallel to the axis between the slicer face 76 and the slicer blade edges 96 is in a range of from 0.010-0.025 inches. Of course this configuration is exemplary and in other arrangements other approaches and configurations may be used.

In the exemplary configuration of the slicer 80 each slicer blade edge 96 extends generally parallel to the radial direction. For purposes hereof generally parallel to the radial direction shall mean between plus or minus 30° from parallel to the radial direction. In the exemplary arrangement the exemplary slicer blade edges 96 extend at a taper such that the slicer blade edge 96 is positioned further away from a radius represented D of the respective slicer arm 92 on which the slicer blade edge is positioned, with closer radial proximity to the axis 36. In the exemplary arrangement the slicer blade edges 96 are tapered at an angle S of from 10 to 25°. Of course it should be understood that this configuration is merely exemplary and in other arrangements other approaches and configurations may be used.

Figure 16:
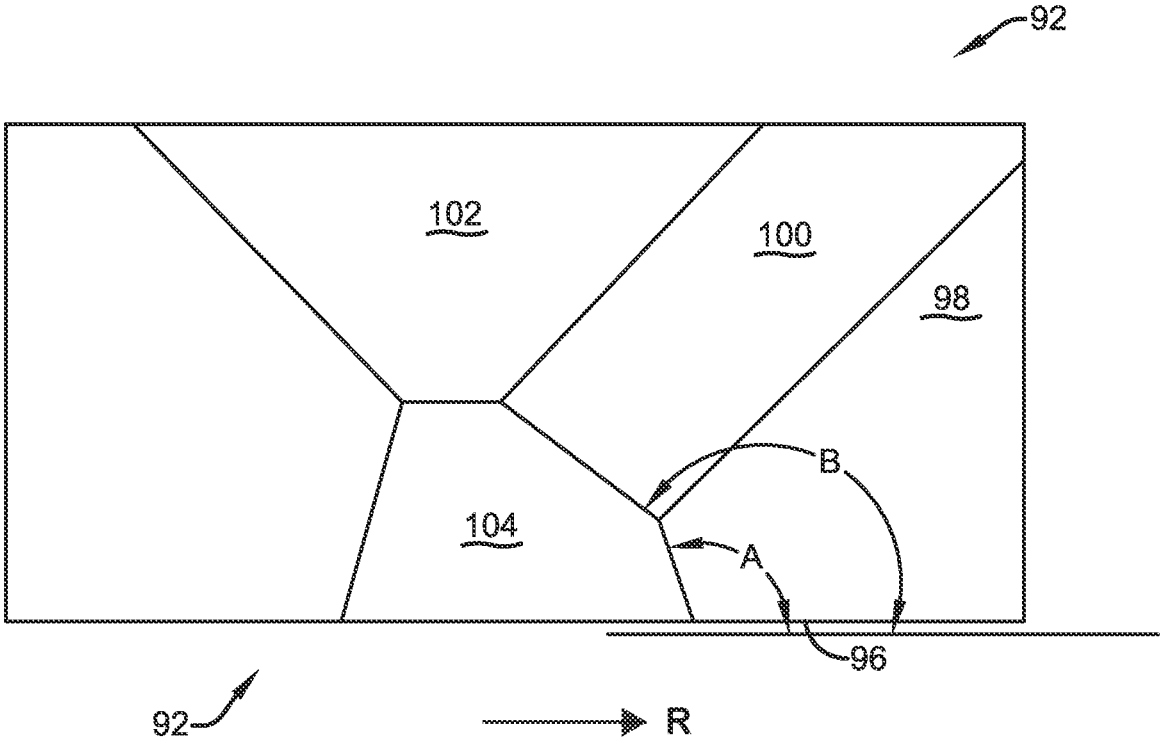
FIG. 16 is an enlarged right side view of the exemplary slicer.
Figure 18:
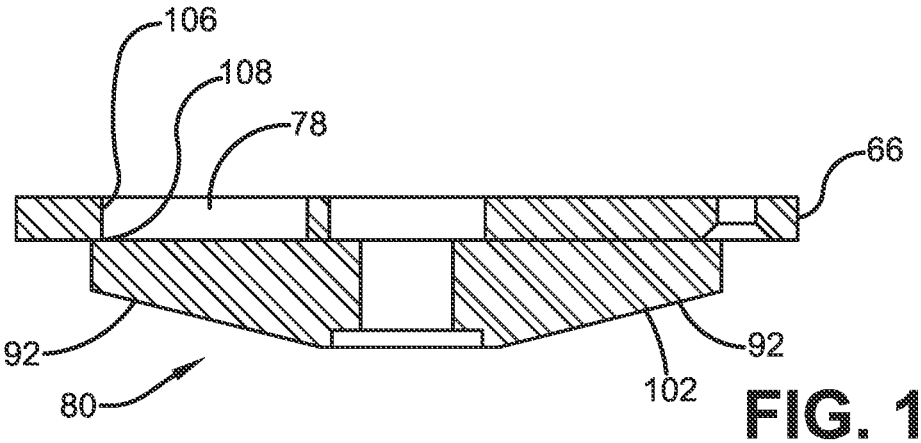
FIG. 18 is a cross sectional view along line 18-18 in FIG. 17.
Figure 17:
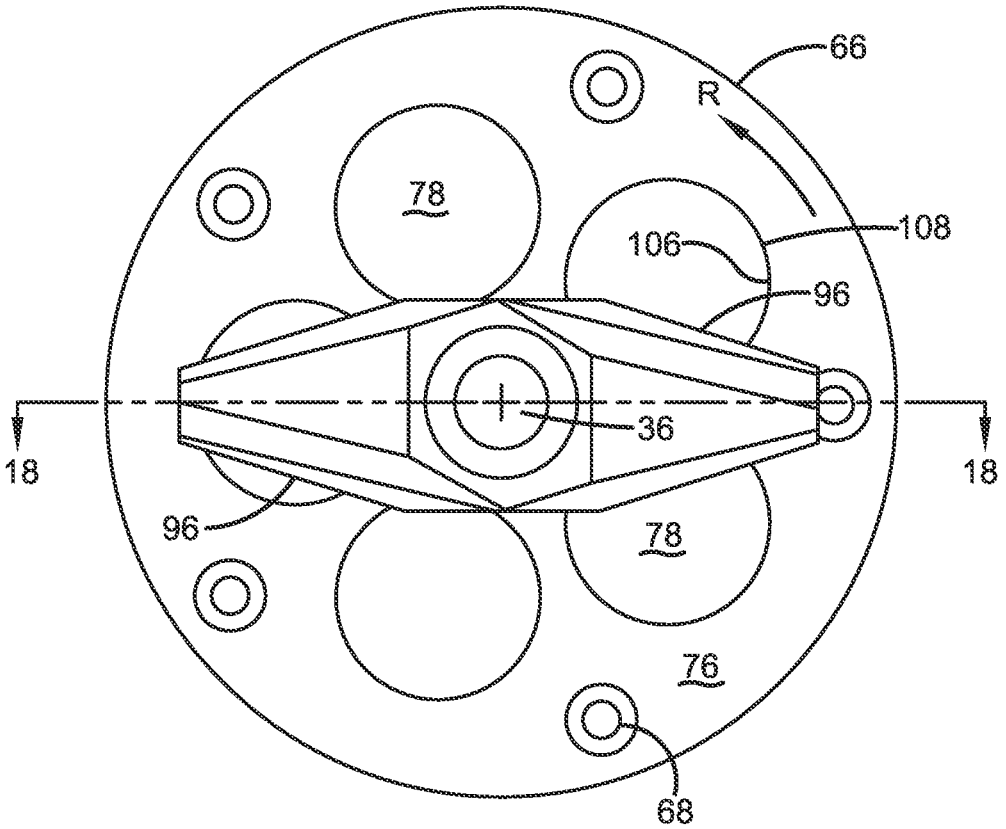
FIG. 17 is a bottom view of the exemplary slicer and slicer plate.

In the exemplary slicer configuration each leading edge 92 includes an inner portion 98 and an outer portion 100. The inner portion 98 which is alternatively referred to herein as an upper portion, terminates immediately adjacent to the slicer face 76 at the slicer blade edge 96 and extends outward therefrom in transverse cross section at an obtuse angle relative to the slicer face that extends ahead of the blade edge in the rotation direction. This first angle is represented in FIG. 16 as angle A. The outer portion 100 which is alternatively referred to herein as a lower portion, extends outwardly (downward) from the inner portion 98 and in transverse cross section at a second obtuse angle relative to the slicer face that extends ahead of the slicer blade edge in the rotation direction. In the exemplary arrangement this second obtuse angle which is represented in FIG. 16 as angle B, is a greater obtuse angle than angle A.

Figure 13:
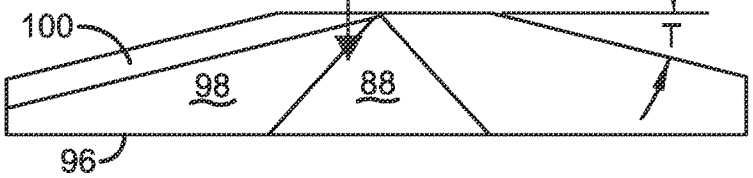
FIG. 13 is a front view of the exemplary slicer.
Figure 14:
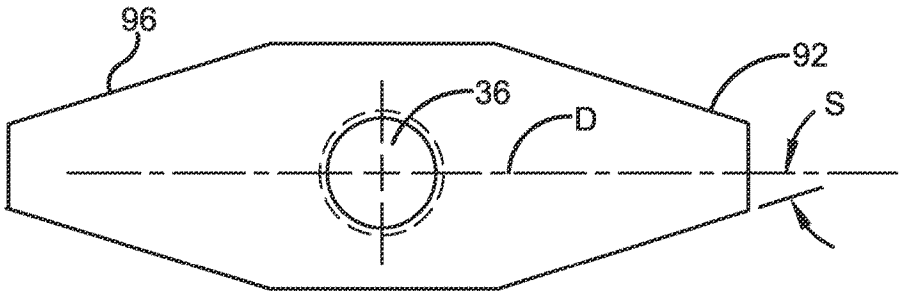
FIG. 14 is a bottom view of the exemplary slicer.
Figure 15:
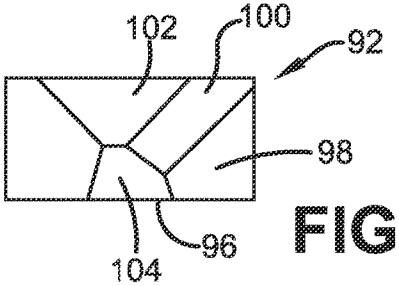
FIG. 15 is a right side view of the exemplary slicer.

Further in the exemplary arrangement the slicer arms are bounded downwardly when in the operative position by a tapered planar surface 102. Tapered planar surface 102 is configured to extend in the operative position further downward from the respective end 104 of the respective slicer arm 92, with closer radial proximity to the central body portion 90 and the axis 36. In exemplary arrangements the tapered planar surface 102 extends at a downward angle indicated T in FIG. 13 that is in a range of from 10°-30°. Of course this configuration is exemplary and in other arrangements other approaches and configurations may be used.

The exemplary configuration of the slicer 80 and its respective slicer leading surfaces 94 are useful in providing a slicer blade edge on the inner portion 98 that is immediately adjacent to the slicer face 76 and the slicer plate fluid openings that extend therethrough. The inner portion and respective slicer blade edge of the exemplary arrangement, in transverse cross section extend at the obtuse angle relative to the slicer face 76 and transverse to the annular surfaces 106 that bound the slicer plate fluid openings that extend through the slicer plate and the respective peripheral edge 108 of each respective fluid opening that is positioned at the slicer face 76. In the exemplary configuration the inner portion 98 also extends transverse of the direction of fluid flow (and the flow of suspended solids) into the slicer plate fluid openings 78. As a result the solids that extend in the slicer plate fluid openings are sliced into smaller pieces between the slicer blade edge and the peripheral edge of each slicer plate fluid opening that extends in a facing direction opposed of the direction of blade edge movement in outwardly overlying relation of the slicer plate. In the exemplary arrangement the peripheral edge of each slicer plate fluid opening that extends in the facing direction, serves as a slicer plate opening shearing edge which results in any solids that extend transversely intermediate of the blade edge and the slicer plate opening shearing edge, being sliced into smaller pieces.

Further in the exemplary arrangement the outer (lower) portion 100 of the leading surface 94 which has in transverse cross section the larger obtuse angle relative to the plane of the exemplary slicer face 76 that is ahead of the blade edge in the rotational direction, operates to push liquid and solid materials suspended therein somewhat away from the slicer face. This exemplary configuration reduces the risk of elongated or stringy solids remaining engaged with the inner portion 98 during slicer rotation. In the exemplary arrangement the tapered planar surfaces 102 which bound the slicer at the lower end in the operative position of the pump, further avoid certain types of solids from remaining continuously engaged with the leading surfaces 94 of the slicer. This exemplary configuration enables solids to remain suspended in the liquid so that they can be moved intermediate of a slicer blade edge and a slicer plate opening shearing edge of a slicer plate fluid opening with the flow of liquid so that such solids are sliced to a smaller size and enabled to flow through the pump. Of course it should be understood that this configuration and these approaches are exemplary and in other arrangements other approaches and configurations may be used.

As shown in FIGS. 17-22 in the exemplary arrangement each blade edge 96 of the exemplary slicer 80 is positioned to pass outwardly in overlying relation of all of the slicer plate fluid openings 78 as the slicer rotates about the axis 36 responsive to the motor 28. Each slicer blade edge 96 passes in outward overlying relation of (below) the entirety of each continuous peripheral edge 108 of each slicer plate fluid opening 78 in the exemplary arrangement. This enables each slicer blade edge 96 to perform the slicing function each time it passes in immediately adjacent outwardly overlying relation to each of the slicer plate fluid openings 78. This configuration of the exemplary arrangement further helps to facilitate the slicing function that is accomplished by the slicer 80 and the slicer plate 66. Further in the exemplary arrangement the annular surfaces 106 adjacent to the peripheral edge 108 of each respective slicer plate fluid opening 78 helps to facilitate the slicing function.

This results because the exemplary annular surfaces 106 extend perpendicular to the slicer face 76. The relative angles of the blade edges 96 and the annular surfaces 106 that extend from the respective peripheral edges 108 provide for effective shearing of solids therebetween. Further it should be understood that while in the exemplary arrangement the annular surfaces 106 extend perpendicular to the slicer face 76, in other exemplary arrangements the annular bounding surfaces may be tapered so as to have an increasing diameter with increasing distance away from (upward from) the peripheral edge at the slicer face. This configuration may be used in some exemplary arrangements in which the relative angular orientations of the blade edges and peripheral surfaces that serve as a slicer plate opening shearing edge, provide greater angular contact, which may be useful in shearing certain types of solid material. Of course it should be understood that these approaches are exemplary and in other arrangements other approaches and configurations to facilitate the shearing of solids may be utilized.

As used herein a slicer is defined as a structure that moves relative to the slicer plate and the slicer plate fluid openings therein, that includes at least one slicer blade edge that is operative to slice solids that extend intermediate of the respective slicer blade edge and a peripheral edge that bounds a slicer plate fluid opening at the outer slicer face, and which peripheral edge extends in a facing direction opposed of a blade edge as the blade edge is moving in outwardly overlying adjacent relation of the slicer face and slicer plate fluid opening. For purposes hereof the slicer plate is defined as a structure with at least one fluid opening through which liquid can flow into a pump chamber of a pump, each of which fluid openings is bounded by a peripheral edge in facing relation that is opposed of a moving direction of the blade edge, and which peripheral edge serves as a shearing edge that acts in cooperating relation with an immediately adjacent blade edge to slice solids that are positioned intermediate of the blade edge and the shearing edge of the plate fluid opening. It should be understood that the configuration of the slicer 80 with the blade edges 96 that rotate about the axis, and in which the blade edges extend generally parallel to a radial direction and are in immediately adjacent overlying relation below circular openings that extend in a planar slicer face 76 is a configuration that is merely exemplary, and in other arrangements other configurations of a slicer and a slicer plate may be used.

For example in some exemplary arrangements the slicer may be comprised of a plate with one or more apertures that moves relative to fluid openings in another plate. Such arrangements may also include a driving arrangement such as a peripheral drive arrangement, rather than a central axial operative connection to a motor drive shaft. In other arrangements the slicer may comprise numerous different types and configurations of relatively moving blades that operate in conjunction with stationary or moving structures to provide the solids slicing function. Further in some exemplary arrangements the blades may be arranged to move in opposed directions relative to each other to slice solids that may extend in between. Numerous different structures and configurations may be utilized in exemplary arrangements to achieve the function of slicing solids into smaller pieces before they enter the interior area of the pump so that the pump may pass the solid material therethrough without causing damage.

A further aspect of the exemplary arrangement enables the slicing of solids with reduced risk of the solids causing excessive resistance to slicer movement that may overload or stall the motor. In the exemplary arrangement the configuration of the slicer blades and the slicer plate fluid openings provide for only one of the cutting blades to be operating substantially in a cutting condition at any given time. This is achieved in the exemplary arrangement by the configuration of the slicer and the slicer plate fluid openings, and in the exemplary arrangement by the slicer having an even number, namely two blade edges, and the slicer plate having an odd number of uniformly spaced slicer plate fluid openings. Of course it should be understood that this configuration is exemplary and in other arrangements other approaches may be used.

Figure 19:
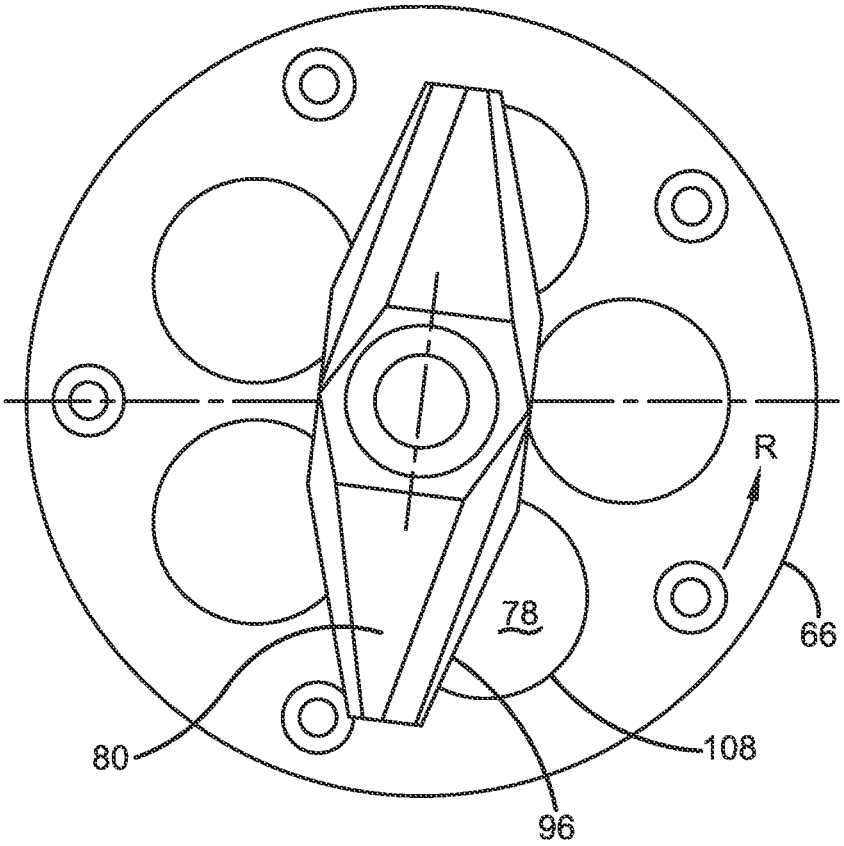
FIG. 19 is a bottom view of the exemplary slicer and slicer plate with one slicer blade edge in a cutting condition.

For example as shown in FIG. 19 the exemplary slicer 80 has the slicer blade edge positioned in outwardly overlying relation of respective slicer plate fluid openings 78. In this position a portion of the peripheral edge 108 of the respective slicer plate fluid opening extends in a facing direction opposed of the edge moving direction R of the moving blade edge 96. As used herein the portion of the peripheral edge 108 that is in a facing direction opposed of the edge moving direction is that portion of the peripheral edge 108 that extends to any extent transversely of the edge moving direction. In the exemplary arrangement this includes the peripheral edge portion 110 that begins with the points along the peripheral edge 108 below which the blade edge extends when in diametrically across relation of the slicer plate fluid opening. Thus as can be appreciated, peripheral edge portion 110 that extends in the facing direction of the blade edge moving direction serves as a slicer plate opening shearing edge of the slicer plate fluid opening.

Figure 20:
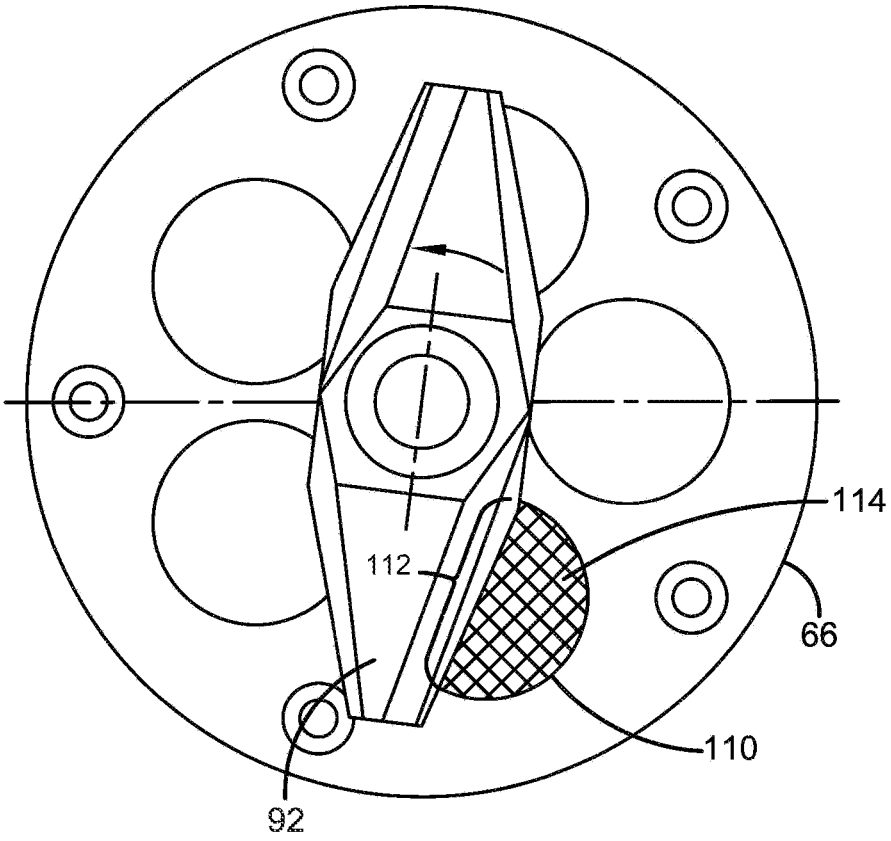
FIG. 20 is a bottom view similar to FIG. 19 showing the area of the plate fluid opening between the blade edge cutting length and the slicer plate fluid opening shearing edge.

In this exemplary arrangement a respective slicer blade edge that extends in outwardly overlying relation of (below) the peripheral edge of the slicer plate fluid opening is in a cutting condition as the blade edge cutting length shown as 112 in FIG. 20, that extends in outwardly overlying relation of the slicer plate fluid opening, and an area 114 of the respective plate fluid opening that extends between the blade edge cutting length and the slicer plate opening shearing edge 110, is decreased with corresponding movement of the blade edge in the blade moving direction. Thus as can be appreciated as the blade edge moves from the position in which the blade edge extends diametrically across in overlying relation of the slicer plate fluid opening, the area 114 between the blade edge and the slicer plate opening shearing edge 110 of the slicer plate opening, decreases. Also with further slicer movement the blade edge cutting length 112 overlying the slicer plate fluid opening and the acting slicer plate fluid opening shearing edge 110 both simultaneously decrease, which focuses the shearing force so that any solids which may be present in the area are sheared, sliced and reduced to a smaller size.

Figure 21:
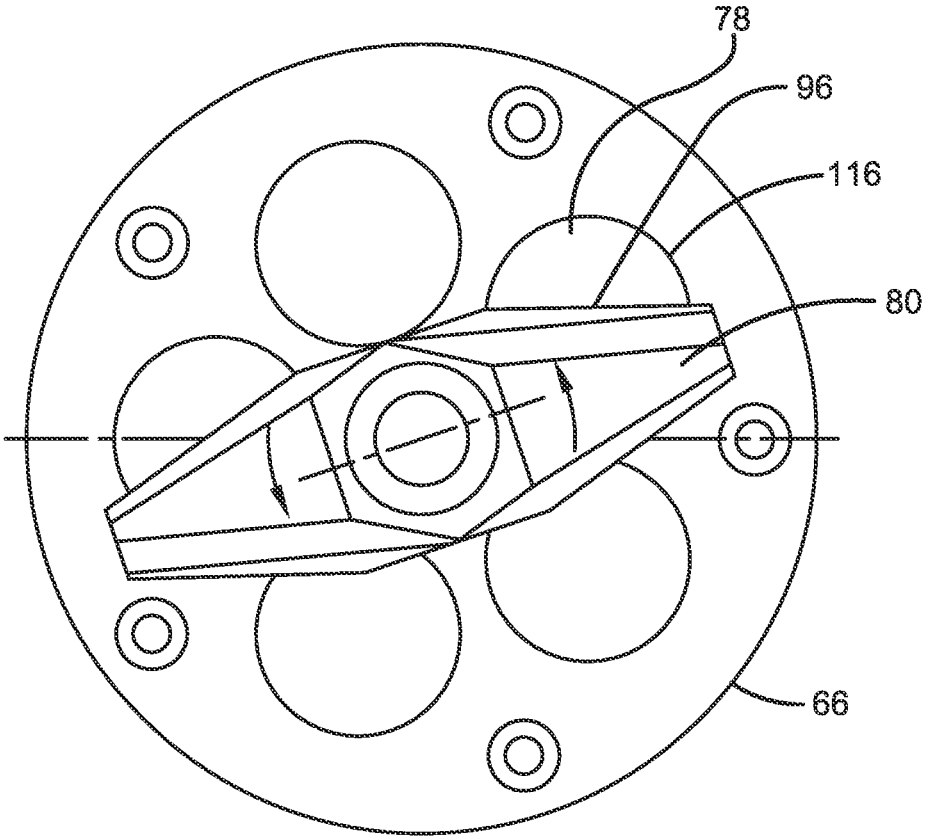
FIG. 21 is a bottom view of the exemplary slicer and slicer plate with one slicer blade edge in a cutting condition with respect to a different slicer plate fluid opening than the slicer plate fluid opening in FIG. 19.
Figure 22:
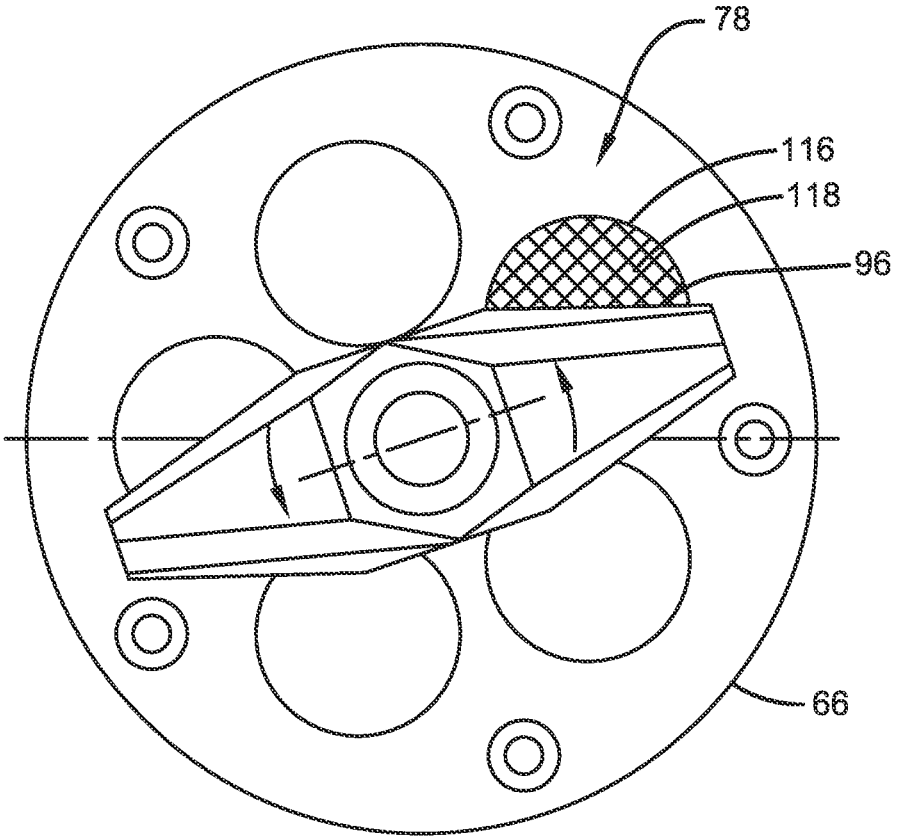
FIG. 22 is a bottom view similar to FIG. 21 showing the area of the slicer plate fluid opening between the blade cutting edge length and the slicer plate fluid opening shearing edge.

FIGS. 21 and 22 show another example of a slicer blade edge 96 of the slicer 80 operating in a cutting condition. In the position shown in FIGS. 21 and 22 the slicer blade edge 96 is shown extending generally diametrically across in overlying relation of (below) another respective underlying slicer plate fluid opening 78. In this exemplary configuration the portion of the peripheral edge 116 of the fluid opening that is in the facing direction opposed of the edge moving direction of the blade edge, serves as a slicer plate fluid opening shearing edge for slicing solids between the respective blade edge 96 and the peripheral shearing edge portion 116.

As represented in FIG. 22 an area 118 between the blade edge cutting length of the blade edge 96 in overlying relation of the slicer plate fluid opening 78 and the peripheral shearing edge portion 116, decreases with movement of the blade edge. Again as with the prior example that was explained with reference to the other slicer plate opening, any solids that are suspended in the liquid between the slicer blade edge and the slicer plate fluid opening peripheral shearing edge are sliced and made smaller through operation of the slicer.

As can be appreciated from these examples, in the exemplary arrangement at any given point in time only one blade edge is in a cutting condition. As a result any added resistance to slicer rotation that may be caused by the presence of solids between the one blade edge and the one slicer plate fluid opening shearing edge is generally not so great as to slow or stall the motor. Further this configuration enables the application of a concentrated slicing force sequentially has each blade edge passes sequentially in outwardly overlying relation underneath each shearing edge.

Of course it should be understood that the cutting condition of the exemplary arrangement is configured to occur via the decrease in area between the moving straight elongated blade edge and the stationary curved shearing edge of the slicer plate fluid opening. However in other arrangements other configurations of a blade edge and a shearing edge may be utilized. Such alternative arrangements may include for example, blade edges with points, separations or other cutting features. Such alternative arrangements may further include fluid openings having different perimeter configurations such as rectangular shapes, triangular shapes, shapes including teeth or other cutting features. Numerous different configurations utilizing the principles discussed herein may be utilized.

In exemplary arrangements the slicer 80 and the slicer plate 66 are comprised of relatively hard and abrasion resistant materials. These may include stainless steels or other materials with suitable properties for handling the types of solids which are encountered in the particular liquid being pumped. Further in exemplary arrangements the slicer 80 is made to be readily disengageable from operative connection with the drive shaft such as by loosening the fastener 86 so that the slicer 80 may be periodically replaced. Likewise in the exemplary arrangement the fasteners that are utilized to hold the slicer plate 66 in engagement with the lower housing portion 16 may be readily removed so that the slicer plate may be replaced. This exemplary configuration enables the external slicing efficiency of the exemplary submersible pump to be rejuvenated without the need to access the structures within the interior area of the pump housing 12. Of course these approaches are exemplary and in other arrangements other approaches may be used.

In the exemplary operational arrangement the submersible pump 10 is positioned in a fluid containing area such as a sump. In the operative position the axis extends vertically and the slicer 80 is at the bottom of the pump. The legs 26 assure that the slicer is disposed away from the bottom of the fluid holding area and is free to rotate and receive liquid through the plate fluid openings 78. When the motor 28 is caused to operate responsive to signals from a float switch or other actuator, the drive shaft 34 operates to cause rotation of the impeller 56 and the slicer 80. Liquid is drawn upwardly through the plate fluid openings 78, through the housing inlet 46 and into the inlet opening 44 of the pump chamber 42.

As the liquid moves from outside the housing and below the slicer plate 66 toward the plate fluid opening 78, solids that may be suspended in the liquid are engaged with the slicer blade edges 92. The solids are sheared between the slicer blade edges and the peripheral shearing edges of the slicer plate fluid openings. The solids are sheared to a smaller size that enables flow of the size reduced solids into the pump chamber along with the liquid.

The liquid and solids enter the central area of the impeller 56 and are propelled radially outward by the vanes 65 toward the outlet opening 50. The liquid and suspended solids flow outward from the pump through the pump outlet 52 and are conducted thereafter to a suitable location.

It should be understood that the principles described herein may be utilized in connection with other pump configurations and with other than a submersible pump. Further while the exemplary arrangement provides for the slicer to be positioned in immediately adjacent vertically overlying relation below a slicer plate, in other arrangements the slicer plate may be positioned in other orientations. Numerous different pump configurations may be utilized in arrangements that employ the principles and useful aspects described herein.

Thus the exemplary arrangements described herein achieve improved operation, eliminate difficulties encountered in the use of prior devices and systems, and attain the useful results that are described herein.

In the foregoing description, certain terms have been used for brevity, clarity and understanding. However no unnecessary limitations are to be implied therefrom because such terms are used for descriptive purposes and are intended to be broadly construed. Moreover the descriptions and illustrations herein are by way of examples, and the new and useful features, arrangements and/or configurations are not limited to only those that have been described.

It should be understood that features and/or relationships associated with one described exemplary arrangement can be combined with features and/or relationships from another exemplary arrangement. That is, features and/or relationships from the various exemplary arrangements can be combined into further arrangements. The new and useful scope of the disclosure is not limited only to the exact arrangements that have been shown and described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

I claim:

1. A pump apparatus comprising:

a housing, a motor, wherein the motor is in operative connection with the housing, wherein the motor is in operative connection with a drive shaft, wherein the drive shaft extends along an axis, a pump chamber, wherein the pump chamber is positioned within the housing, wherein the pump chamber includes an axially extending inlet opening configured to enable liquid flow into the pump chamber, and an outlet opening configured to enable liquid flow out of the pump chamber, an impeller, wherein the impeller is rotatably positioned in the pump chamber, wherein the impeller is in operative connection with the drive shaft and is rotatable about the axis, a slicer plate, wherein the slicer plate extends in axially disposed outward overlying relation of the inlet opening, wherein the slicer plate includes a slicer face, wherein the slicer face is directed away from the inlet opening, an axially aligned slicer plate drive opening, wherein the slicer plate drive opening extends through the slicer plate, at least one slicer plate fluid opening, wherein each slicer plate fluid opening extends through the slicer plate and is disposed radially away from the slicer plate drive opening, wherein each slicer plate fluid opening is circular and extends entirely within a single plane at the slicer face, a slicer, wherein the slicer extends in axially outwardly overlying relation of the slicer plate, is in operatively engaged rotatable connection with the drive shaft via the slicer plate drive opening, includes at least one blade edge, wherein each blade edge extends entirely in a further plane and is positioned in immediate adjacent axially outwardly overlying relation of the slicer face, wherein rotation of the drive shaft by the motor is operative to cause rotation of the impeller and the slicer, whereby the impeller rotation is operative to cause liquid to flow from outside the housing through the at least one slicer plate fluid opening, through the inlet opening and the pump chamber, and outward through the outlet opening while each blade edge of the slicer is operative to move in outwardly overlying immediately adjacent relation over the entirety of each slicer plate fluid opening and to slice solid material that extends in the at least one slicer plate fluid opening.

2. The apparatus according to claim 1 wherein the motor is operative to rotate the drive shaft in a rotation direction, wherein a leading surface of the slicer during movement of the slicer in the rotation direction includes a respective one of the at least one blade edge, and wherein the one blade edge is radially outwardly tapered such that along a radius extending from the axis, the one blade edge is positioned further away from the radius with proximity to the axis.

3. The apparatus according to claim 1 wherein the at least one blade edge of the slicer includes only a pair of elongated blade edges, wherein each blade edge is disposed radially outward from the axis, and extends on a radially opposed side of the axis from the other blade edge.

4. The apparatus according to claim 1 wherein the motor is operative to cause each blade edge of the slicer to move in an edge moving direction, wherein each slicer plate fluid opening is circular at the slicer face and is outwardly bounded in a facing direction opposed of the edge moving direction, by a slicer plate opening shearing edge, wherein movement of a respective blade edge in the edge moving direction is operative to cause a linearly straight blade edge cutting length of the respective blade edge that extends in outwardly overlying relation of a respective slicer plate fluid opening, to extend entirely diametrically across and thereafter to decrease with corresponding decreased area of the respective slicer plate fluid opening that extends between the blade edge cutting length and the slicer plate opening shearing edge.

5. The apparatus according to claim 1 wherein the motor is operative to cause each blade edge of the slicer to move in an edge moving direction, wherein each respective blade edge in the edge moving direction moves entirely within a first plane in outwardly overlying relation entirely across each slicer plate fluid opening, wherein each slicer plate fluid opening is circular at the slicer face and extends entirely within a second plane at the slicer face that extends parallel to the first plane, and is bounded in a facing direction, opposed of the edge moving direction, by a slicer plate opening shearing edge that extends entirely within the second plane, whereby solid material is sliced between a respective blade edge and a respective immediately adjacent slicer plate opening shearing edge.

6. The apparatus according to claim 1 wherein the motor is operative to cause each blade edge of the slicer to move in an edge moving direction, wherein movement of a respective blade edge in the edge moving direction causes the respective blade edge to move in outwardly overlying relation entirely across each slicer plate fluid opening, wherein each slicer plate fluid opening at the slicer face extends in a single plane, is circular and is bounded at the slicer face in a facing direction opposed of the edge moving direction, by a slicer plate opening shearing edge, whereby solid material is sliced between the respective blade edge and the respective immediately adjacent slicer plate opening shearing edge, wherein each respective blade edge is in a cutting condition when a continuously linearly straight blade edge cutting length portion of the respective blade edge that extends diametrically across and in outwardly overlying relation of the respective slicer plate fluid opening, and an area of the respective underlying slicer plate fluid opening between the blade edge cutting length portion and the slicer plate opening shearing edge, is decreased to zero with corresponding movement of the blade edge in the edge moving direction, wherein the at least one blade edge of the slicer and the at least one slicer plate fluid opening are configured such that only one blade edge of the slicer at a time is ever in the cutting condition.

7. The apparatus according to claim 1 wherein the motor is operative to cause each blade edge of the slicer to move in an edge moving direction, wherein respective blade edge movement in the edge moving direction causes each respective blade edge to move in outwardly overlying relation entirely across each at least one slicer plate fluid opening, wherein each slicer plate fluid opening is bounded at the slicer face in a facing direction opposed of the edge moving direction, by a slicer plate opening shearing edge, whereby solid material is sliced between the respective blade edge and the respective immediately adjacent slicer plate opening shearing edge, wherein a respective blade edge is in a cutting condition when a blade edge cutting length of the respective blade edge that extends in outwardly overlying relation of a respective slicer plate fluid opening, and an area of the respective underlying slicer plate fluid opening between and blade edge cutting length and the slicer plate opening shearing edge is decreased to below one half of a total area of the respective slicer plate fluid opening and is further decreased with corresponding movement of the blade edge in the edge moving direction, wherein the at least one blade edge of the slicer consists of an even number of uniformly angularly spaced blade edges, and the at least one slicer plate fluid opening consists of an odd number of uniformly angularly spaced slicer plate fluid openings, wherein only one blade edge of the slicer at any a time is in the cutting condition.

8. The apparatus according to claim 1 wherein each blade edge of the slicer is movable responsive to operation of the motor in outwardly overlying relation across each slicer plate fluid opening, and wherein the at least one blade edge of the slicer consists of an even number of uniformly angularly spaced blade edges, and the at least one slicer plate fluid opening consists of an odd number of uniformly angularly spaced slicer plate fluid openings.

9. The apparatus according to claim 1
wherein each slicer plate fluid opening at the slicer face comprises a circular slicer plate fluid opening,
wherein each slicer plate fluid opening
extends entirely in a first plane at the slicer face,
is of a common diameter,
is centered at a common radial distance from the axis, and
is equally angularly spaced from each other slicer plate fluid opening,
wherein the at least one blade edge includes only two blade edges, each of which extends entirely in a second plane and is generally parallel to a radial direction, wherein during rotation of the slicer each blade edge passes in overlying relation of the entirety of each slicer plate fluid opening, and
wherein at any time during rotation of the slicer no more than one blade edge is in a cutting condition with respect to any of slicer plate fluid openings.

10. The apparatus according to claim 1
wherein each slicer plate fluid opening is outwardly bounded at the slicer face by respective slicer plate fluid opening continuous peripheral edge that extends entirely in a first plane,
wherein each blade edge is moved responsive to the motor entirely in a second plane that extends parallel to the first plane in outwardly overlying relation of an entirety of each respective slicer plate fluid opening continuous peripheral edge of each slicer plate fluid opening.

11. The apparatus according to claim 1
wherein the motor is operative to cause the slicer to rotate in a rotation direction,
wherein the slicer includes at least one leading surface which faces in a direction of movement of the slicer as the slicer moves in the rotation direction,
wherein in radially transverse cross section each leading surface terminates immediately adjacent to the slicer face at a respective blade edge,
wherein each leading surface extends at an obtuse angle relative to the slicer face ahead of the respective blade edge in the rotation direction.

12. The apparatus according to claim 1
wherein the motor is operative to cause the slicer to rotate in a rotation direction,
wherein the slicer includes at least one leading surface which faces in a direction of movement of the slicer as the slicer moves in the rotation direction,
wherein each leading surface in an operative position in radially transverse cross section includes
an inner leading surface portion and an outer leading surface portion,
wherein each inner leading surface portion terminates immediately adjacent to the slicer face at a respective slicer blade edge,
wherein each inner leading surface portion extends at a first obtuse angle relative to the slicer face ahead of the respective slicer blade edge in the rotation direction,
wherein each outer leading surface portion extends
away from the inner leading surface portion in a direction away from the slicer face, and
at a second obtuse angle relative to the slicer face ahead of the respective blade edge in the rotation direction, wherein the second obtuse angle is greater than the first obtuse angle.

13. The apparatus according to claim 1
wherein the motor is operative to cause the slicer to rotate in a rotation direction,
wherein the slicer includes only two radially opposed leading surfaces, each of which faces in a direction of movement of the slicer as the slicer moves in the rotation direction,
wherein each leading surface terminates immediately adjacent to the slicer face at a respective slicer blade edge,
wherein in radially transverse cross section each leading surface extends at an obtuse angle relative to the slicer face ahead of the respective slicer blade edge in the rotation direction,
wherein in an operative position of the slicer, each respective leading surface terminates away from the slicer face at a respective lower planar surface that extends transversely of the respective leading surface, and
closer to the slicer plate with increased radial distance away from the axis.

14. The apparatus according to claim 1
wherein the motor is operative to cause the slicer to rotate in a rotation direction,
wherein the slicer includes at least one leading surface which faces in a direction of movement of the leading surface as the slicer moves in the rotation direction,
wherein each leading surface includes an upper portion and a lower portion,
wherein the upper portion of each leading surface terminates immediately adjacent to the slicer face at a respective slicer blade edge,
wherein in radially transverse cross section the upper portion of each leading surface extends away from the respective slicer blade edge and slicer face at a first obtuse angle relative to the slicer face ahead of the respective slicer blade edge in the rotation direction, and the lower portion of each leading surface extends away from the upper portion and relative to the slicer face at a second obtuse angle relative to the slicer face ahead of the respective slicer blade edge in the rotation direction, where the second obtuse angle is greater than the first obtuse angle,
wherein in an operative position of the slicer, the respective leading surface terminates downward away from the blade edge at a respective planar surface that extends transversely of the respective leading surface,
wherein each planar surface extends further away from the slicer face with proximity to the axis.

15. A pump apparatus comprising:
a housing,
a motor, wherein the motor
is in operative connection with the housing,
includes a rotatable drive shaft,
a pump chamber, wherein the pump chamber
extends within the housing,
includes an inlet opening configured to enable liquid flow into the pump chamber,
includes an outlet opening configured to enable liquid flow out of the pump chamber,
an impeller, wherein the impeller
is in operative connection with the drive shaft, and
is rotatable within the pump chamber,
a slicer plate, wherein in an operative position the slicer plate
extends below the inlet opening,
includes a downward facing planar slicer face, includes at least one slicer plate fluid opening, wherein each slicer plate fluid opening extends through the slicer plate and is configured to be in fluid connection with the inlet opening of the pump chamber, and is bounded at the slicer face by a circular peripheral bounding edge that extends entirely in a first plane, a slicer, wherein in the operative position the slicer extends underneath the slicer plate, is in operative connection with the drive shaft, includes at least one straight linear extending blade edge portion, wherein each at least one blade edge portion is positioned in immediate adjacent relation below the slicer face and extends entirely in a second plane, wherein rotational movement of the slicer responsive to rotation of the drive shaft is operative to cause each blade edge portion to pass in immediate adjacent relation across the entirety of each slicer plate fluid opening, and each blade edge portion to extend diametrically across and in facing relation with a facing portion of the peripheral bounding edge of each slicer plate fluid opening, wherein drive shaft rotation by the motor is operative to cause impeller rotation and slicer rotation, whereby the impeller is operative to cause liquid to flow from outside the housing through the at least one slicer plate fluid opening, through the inlet opening and the pump chamber, and outward through the outlet opening while the at least one blade edge of the slicer is operative to slice solid material that extends in the at least one slicer plate fluid opening, wherein during slicer rotation no more than one blade edge portion at any time is ever rotationally moved between a position extending diametrically across a respective bounding edge of a respective slicer plate fluid opening, and a further position in which there is no area of the respective slicer plate fluid opening horizontally between the respective blade edge portion and the respective facing portion of the bounding edge of the slicer plate fluid opening, whereby each at least one blade edge portion of the slicer is operative to slice solid material that extends in the at least one slicer plate fluid opening.

16. The apparatus according to claim 15 wherein the slicer is selectively releasably engageable with the pump, wherein the slicer is replaceable.

17. The apparatus according to claim 15 wherein the slicer plate is selectively releasably engageable with the pump housing, wherein the slicer plate is replaceable.

18. The apparatus according to claim 15 wherein the slicer includes only a pair of blade edge portions that extend in opposed relation and generally parallel to a radial direction, wherein the slicer plate includes an odd number of evenly angularly spaced slicer plate fluid openings.

19. A pump apparatus comprising:

a housing, a motor, wherein the motor is in operative connection with the housing, wherein the motor is in operative connection with a drive shaft, wherein the drive shaft extends along an axis, a pump chamber, wherein the pump chamber is positioned within the housing, wherein the pump chamber includes an axially extending inlet opening configured to enable liquid flow into the pump chamber, and an outlet opening configured to enable liquid flow out of the pump chamber, an impeller, wherein the impeller is rotatably positioned in the pump chamber, wherein the impeller is in operative connection with the drive shaft and is rotatable about the axis, a slicer plate, wherein the slicer plate extends in axially disposed outward overlying relation of the inlet opening, wherein the slicer plate includes a slicer face, wherein the slicer face is directed away from the inlet opening, an axially aligned slicer plate drive opening, wherein the slicer plate drive opening extends through the slicer plate, at least one slicer plate fluid opening, wherein the at least one slicer plate fluid opening extends through the slicer plate and is disposed radially away from the slicer plate drive opening, a slicer, wherein the slicer extends in axially outwardly overlying relation of the slicer plate, is in operatively engaged rotatable connection with the drive shaft via the slicer plate drive opening, includes at least one blade edge, wherein each blade edge includes a continuously linearly straight blade edge portion that is positioned in immediately adjacent axially outwardly overlying relation of the slicer face, wherein rotation of the drive shaft by the motor is operative to cause rotation of the impeller and the slicer, wherein the impeller rotation is operative to cause liquid to flow from outside the housing through the at least one slicer plate fluid opening, through the inlet opening and the pump chamber, and outward through the outlet opening while the at least one blade edge portion of the slicer is caused to move in an edge movement direction, wherein movement of a respective blade edge portion in the edge movement direction causes the respective blade edge portion to move in outwardly overlying relation across the entirety of each at least one slicer plate fluid opening, wherein each slicer plate fluid opening comprises a circular opening that is bounded at the slicer face in a facing direction opposed of the edge movement direction, by a slicer plate opening shearing edge that extends entirely in a single plane, whereby solid material is sliced between the respective blade edge portion and the respective immediately adjacent slicer plate opening shearing edge, wherein each respective blade edge portion is in a cutting condition between when the respective blade edge portion extends diametrically across and in outwardly overlying relation of a respective slicer plate fluid opening, and thereafter when an area of the respective underlying slicer plate fluid opening between and the blade edge portion and the slicer plate opening shearing edge, is reduced to zero through movement of the blade edge portion in the edge movement direction, wherein the slicer and the slicer plate are configured such that during each slicer rotation no more than one blade edge portion of the slicer at a time is ever in the cutting condition.

20. The apparatus according to claim 19 wherein the slicer includes only two blade edge portions, wherein each blade edge portion extends entirely in a further common plane, is disposed radially outward from the axis, and extends on a diametrically opposed side of the axis from the other blade edge portion.

21. A pump apparatus comprising:

a housing, a motor, wherein the motor is in operative connection with the housing, includes a rotatable drive shaft, a pump chamber, wherein the pump chamber extends within the housing, includes an inlet opening configured to enable liquid flow into the pump chamber, includes an outlet opening configured to enable liquid flow out of the pump chamber, an impeller, wherein the impeller is in operative connection with the drive shaft, and is rotatable within the pump chamber, a slicer plate, wherein in an operative position the slicer plate extends below the inlet opening, includes a downward facing planar slicer face, includes at least one slicer plate fluid opening, wherein each slicer plate fluid opening is circular at the slicer face, extends through the slicer plate and is configured to be in fluid connection with the inlet opening of the pump chamber, a slicer, wherein in the operative position the slicer extends underneath the slicer plate, is in operative connection with the drive shaft, includes at least one blade edge, wherein the at least one blade edge is positioned in immediate adjacent relation below the slicer face, wherein rotational movement of the slicer responsive to rotation of the drive shaft is operative to cause each blade edge to pass entirely across each slicer plate fluid opening, wherein drive shaft rotation by the motor is operative to cause impeller rotation and slicer rotation, wherein the impeller is operative to cause liquid to flow from outside the housing through the at least one slicer plate fluid opening, through the inlet opening and the pump chamber, and outward through the outlet opening while at any time during slicer rotation only one blade edge of the slicer is operative to slice solid material that extends between the one blade edge and a circular periphery at the slicer face of one respective slicer plate fluid opening.

22. The apparatus according to claim 21 wherein each blade edge comprises a linearly straight blade edge portion, wherein the one blade edge of the slicer is operative to slice solid material in the one respective slicer plate fluid opening when in a cutting condition which begins when the blade edge portion extends diametrically entirely across the periphery of the respective slicer plate fluid opening and ends when the blade edge portion next passes across the periphery.

* * * * *